US012268289B2

(12) United States Patent
Fogueteiro

(10) Patent No.: US 12,268,289 B2
(45) Date of Patent: Apr. 8, 2025

(54) BOTTLE FOR PACKAGING AND APPLYING A COSMETIC PRODUCT INCLUDING A POROUS APPLICATION TIP

(71) Applicant: CHANEL PARFUMS BEAUTE, Neuilly-sur-Seine (FR)

(72) Inventor: Paulo Fogueteiro, Neuilly sur Seine (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 0 days.

(21) Appl. No.: 18/407,934

(22) Filed: Jan. 9, 2024

(65) Prior Publication Data

US 2024/0225236 A1 Jul. 11, 2024

(30) Foreign Application Priority Data

Jan. 10, 2023 (FR) ..... 2300248

(51) Int. Cl.
*A45D 34/04* (2006.01)

(52) U.S. Cl.
CPC ..... *A45D 34/04* (2013.01); *A45D 2200/10* (2013.01); *A45D 2200/1009* (2013.01); *A45D 2200/1018* (2013.01)

(58) Field of Classification Search
CPC ..... A45D 34/04; A45D 2200/10; A45D 2200/109; A45D 2200/1018; B43K 1/003;
(Continued)

(56) References Cited

U.S. PATENT DOCUMENTS 3,922,100 A * 11/1975 Saito ..... B43K 8/02 401/199
4,076,427 A * 2/1978 Anderson ..... A46B 5/02 401/6

(Continued)

FOREIGN PATENT DOCUMENTS

CN 112137273 A 12/2020
DE 195 29 865 A1 2/1997

(Continued)

OTHER PUBLICATIONS

French Preliminary Search Report issued in French Patent Application No. FR 2300248, dated Jul. 12, 2023.

(Continued)

*Primary Examiner* — David J Walczak
(74) *Attorney, Agent, or Firm* — GREENBLUM & BERNSTEIN, P.L.C.

(57) ABSTRACT

A bottle including a reservoir for a cosmetic liquid and including a longitudinal neck between the interior and the exterior, an applicator mounted in the neck and including an application tip to apply the product to a user's body, the tip formed from a porous material. A porous wick is formed by, or connected to, the application tip, the wick extending in the reservoir to dip into the product, the application tip being mounted in the neck for imperviousness to the product, and the bottle including at least one channel extending in the neck between the interior of the reservoir and the exterior of the bottle, the at least one channel having a cross-section calibrated to allow passage of air while opposing product passage. Included is an insert between an interior surface of the neck and an external surface of the application tip, with at least one channel formed by the insert.

16 Claims, 7 Drawing Sheets

(58) Field of Classification Search
CPC . B43K 1/006; B43K 1/12; B43K 8/02; B43K 8/022; B43K 8/026; B43K 8/06
USPC ..... 401/198, 199
See application file for complete search history.

(56) References Cited

U.S. PATENT DOCUMENTS

| | | | | |
|---|---|---|---|---|
| 5,286,127 | A * | 2/1994 | Scholz | B43K 8/02 401/199 |
| 5,964,226 | A | 10/1999 | Sobel | |
| 6,183,155 | B1 | 2/2001 | Kaufmann | |
| 6,386,781 | B1 | 5/2002 | Gueret | |
| 6,413,001 | B1 | 7/2002 | Kaufmann | |
| 2001/0016141 | A1 | 8/2001 | Kaufmann | |
| 2002/0054783 | A1 | 5/2002 | Gueret | |

FOREIGN PATENT DOCUMENTS

| | | | |
|---|---|---|---|
| EP | 0 872 193 | A1 | 10/1998 |
| JP | H08-34193 | A | 2/1996 |
| WO | 91/18535 | A1 | 12/1991 |
| WO | 99/12446 | A1 | 3/1999 |
| WO | 2019/121262 | A1 | 6/2019 |

OTHER PUBLICATIONS

Written Opinion issued in French Patent Application No. FR 2300248, dated Jul. 12, 2023.

* cited by examiner

[Fig. 1]
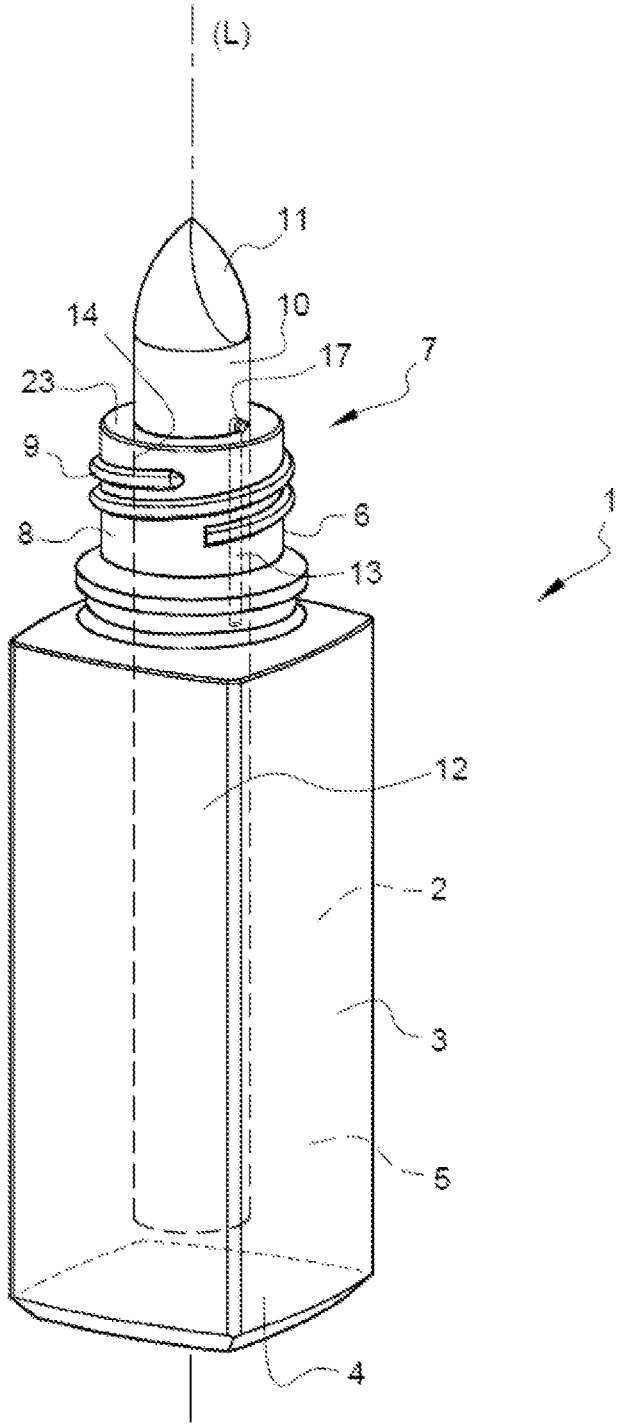

[Fig. 2]
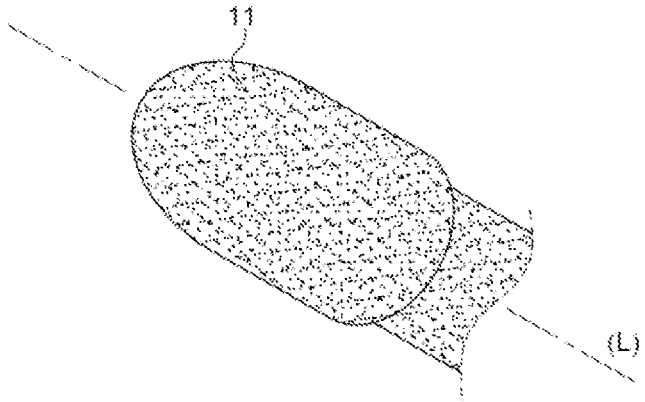
[Fig. 3]
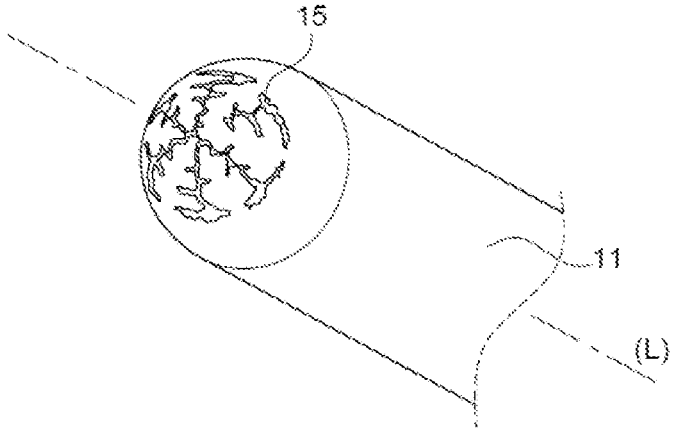
[Fig. 4]
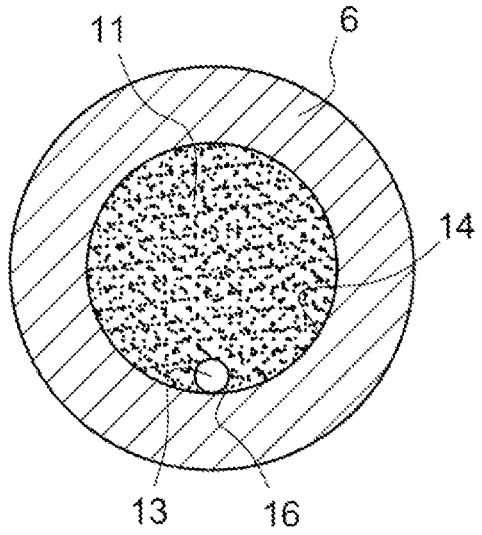

[Fig. 5]
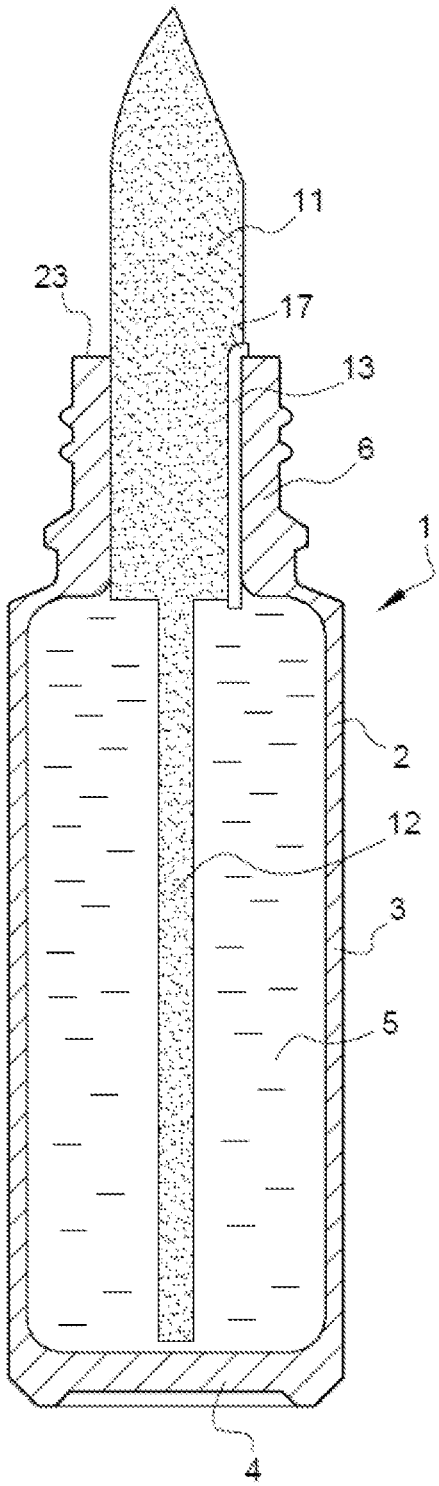

[Fig. 6]
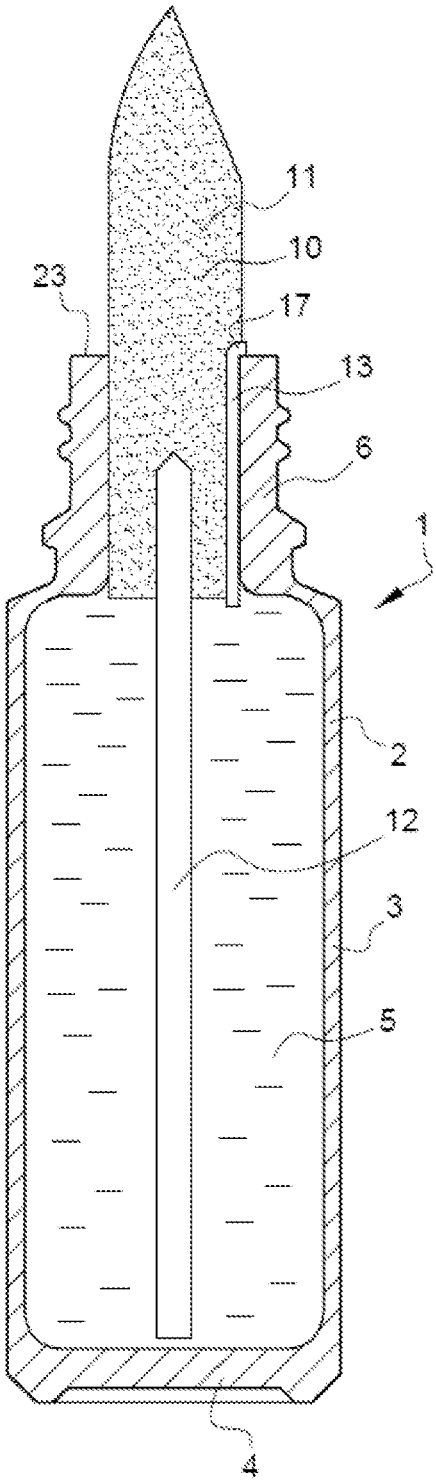

[Fig. 7]
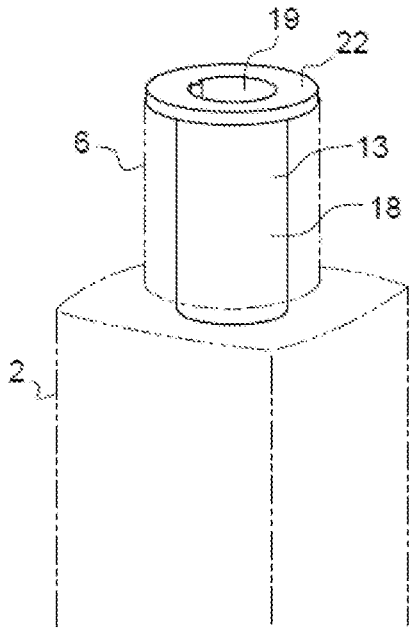
[Fig. 8]
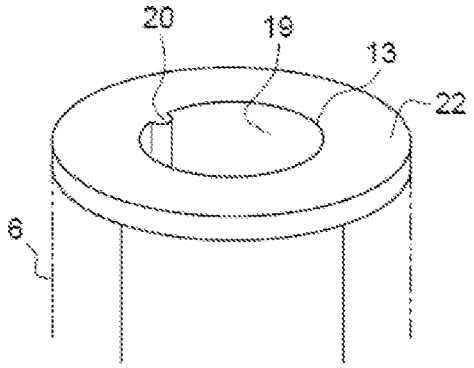
[Fig. 9]
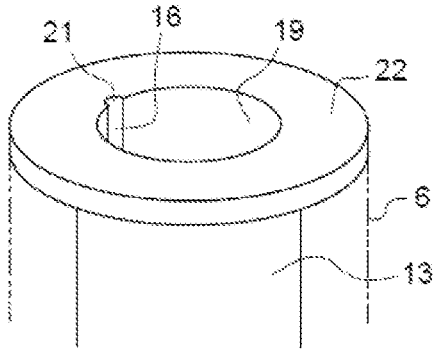

[Fig. 10]
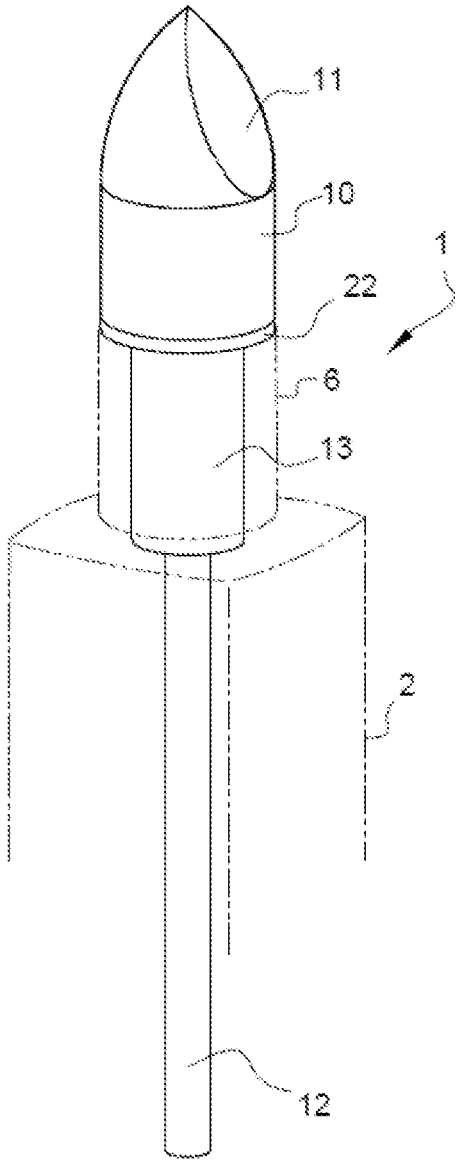
[Fig. 11]
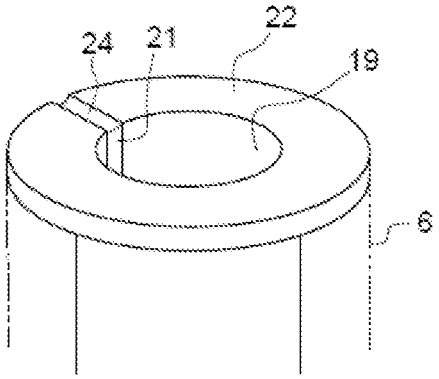

[Fig. 12]
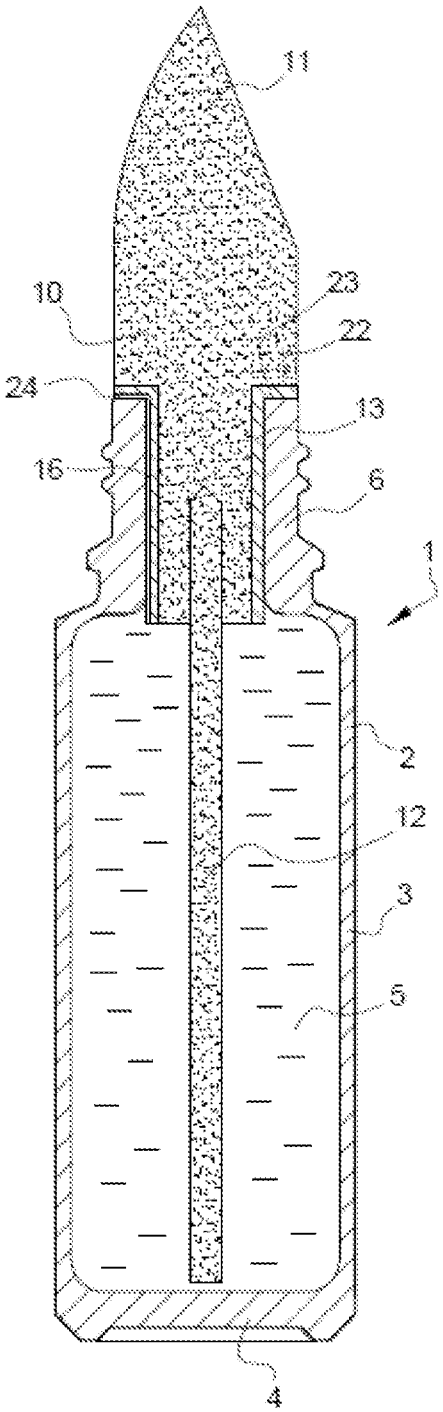

BOTTLE FOR PACKAGING AND APPLYING A COSMETIC PRODUCT INCLUDING A POROUS APPLICATION TIP

CROSS-REFERENCE TO RELATED APPLICATION

The present application claims priority under 35 U.S.C. § 119 of French Patent Application No. FR 2300248, filed Jan. 10, 2023, the disclosure of which is expressly incorporated by reference herein in its entirety.

TECHNICAL FIELD OF THE INVENTION

The invention relates to the field of devices for packaging, dispensing and applying a perfume or a cosmetic product, in particular for toiletries, make-up or treatment.

Cosmetic products include in particular all products for making up the skin or keratinous appendages as well as all perfuming or odorising compositions intended for applying to the body.

Treatment products include in particular products intended to be applied to the human or animal body for treating or preventing a problem or a pathology.

The invention relates in particular to a bottle for packaging and applying such a cosmetic product in liquid form. The term liquid does not exclude the product nevertheless having a certain viscosity, the product being able in particular to be an aqueous or oily product.

Packaging means maintaining the product under adapted storage conditions between two applications of the product.

In the remainder of the present document, the invention is described and exemplified in relation to a cosmetic product, which includes make-up products and treatment products.

PRIOR ART

Numerous types of applicator are known in the prior art. The present invention relates to liquid, low-viscosity, products that it is wished to package in a bottle and then apply easily for example to the lips, skin, hair or keratinous appendages. For simplicity, simply the skin is mentioned in the remainder of the present document, although the invention can be used for applying a product to any part of the body of the user.

For this purpose an applicator is known including an applicator tip adapted to be loaded with product, which is dipped in a bottle before extracting it therefrom when it is loaded with product. The product is applied by rubbing the applicator tip on the skin of the user, or by depositing spots of product by repeated contacts of the applicator on the skin. This type of applicator is suitable for some uses, but has the drawback of having to be reloaded with product frequently. Furthermore, during application, the user must hold or put down the bottle filled with product, which is not always practical.

Furthermore, in this type of applicator, the applicator tip is soaked with the product between two applications, and passes through a wiper when it is extracted from the bottle. This constitutes a complex assembly necessary for obtaining the required quantity of product on the applicator tip, and where applicable avoiding drops of product falling and being lost.

Bottles including an applicator of the ball type (or "roll-on" according to the English expression normally used) are also known. These bottles generally include a flexible tube and a tip with a rotatably mounted ball that is loaded with product on its surface internal to the tip when the tube is pressed. The surface of the ball loaded with product is next turned towards the outside of the tip, rolling on the skin of the user, to enable the product to be applied. The quality of the application depends on the orientation of the applicator, the tip having to be oriented downwards to allow good application. In the case of a flexible bottle, this must be pressed to cause the product to emerge, which is not very practical. In general, the mechanism used is relatively complex and requires good precision to enable the product to be dispensed while avoiding leakages.

It has also been envisaged using an applicator including an application element made from foam capable of soaking up cosmetic product. The document WO2019121262 presents such an applicator. According to this document, the application surface of the application element consists of a compressible foam. The firm is compressed by a cap placed on the application element when the applicator is in the closed position, and expands when the cap is removed. An actuator makes it possible to pressurise the product in order to soak said applicator element. The system is therefore relatively complex, in that it uses moving parts, in particular a piston, and in that impermeability to the product is necessary in the device.

Finally, packaging certain make-ups is known, and in particular certain inks that can be applied to the skin or certain eyeliners (according to the English term generally used, or otherwise "eye pencils" or sometimes "liner"), in the form of a felt pen similar to those used for writing, graphics or drawing.

Such a felt pen includes in a known manner a body a rear part of which constitutes an ink reservoir and a wick the rear end of which emerges in the reservoir and the front end of which forms a writing tip. Such a felt pen further includes a pad in the form of an element made from hydrophobic material with open pores, which is placed around and in contact with the wick. The pad allows regulation of the flow in the wick, and fills with or empties of ink, from or to the wick, by capillarity. This configuration is nevertheless complex, and furthermore involves an elongate shape typical of a pen, which is not desirable for every product. The quantity of product able to be contained and delivered is in fact very small.

DESCRIPTION OF THE INVENTION

The present invention aims to remedy all or some of the drawbacks of the prior art cited above.

For this purpose, the invention aims to propose a bottle for packaging and regular application of a cosmetic liquid product, which does not require repeatedly dipping the application tip in the product and which is simple to use.

Thus the invention relates to a bottle including a reservoir including an interior volume containing a cosmetic liquid product. The reservoir includes a neck extending in a so-called longitudinal direction between the interior volume of the reservoir and the exterior of said reservoir. The bottle includes an applicator mounted in the neck, the applicator including an application tip intended to be put in contact with a part of the body of a user of the bottle to apply the product thereon, the application tip having an application surface formed by a porous material. The application tip is formed from said porous material. The applicator includes a porous wick formed by the application tip or connected to the application tip. The wick extends in the reservoir so as to be dipped in the product.

The application tip is mounted in the neck so as to be impervious to the product. The bottle includes at least one channel extending in the neck between the interior volume of the reservoir and the exterior of the bottle, the at least one channel having a cross-section calibrated to allow the passage of air while opposing the passage of product.

A bottle is thus proposed for packaging cosmetic liquid product in an adapted reservoir, and for dispensing and applying the product by means of an application tip incorporated in the bottle. The product is supplied to the surface of the application tip by capillarity in the wick and in the application tip itself.

By providing a channel the cross section of which is calibrated to allow passage of air while preventing passage of product, any leakage of product is avoided, even for example when the bottle is held with the application tip oriented towards the ground, while the capillarity effect is favoured in the wick and in the application tip by providing equilibrium of pressure between the interior and the exterior of the reservoir.

The principle of capillarity and of equilibrium of pressure used in the invention means that no external force has to be applied by the user to enable the product to be dispensed: it is not necessary to compress the bottle (which has no need to be deformable), and it is not necessary either to turn it over.

In order to form the application tip, a porous material relatively resistant to crushing is selected. In particular, the material has to be only slightly crushed during application and pressing on the skin (or other part of the body) by a user, with a force conventionally used for applying a cosmetic product.

Likewise, if the application tip is mounted gripped in the neck, it does not have to be subjected to compression that would substantially reduce the porosity thereof.

Since the flow of product is regulated in a simple manner, in the neck of the bottle, the bottle can have a compact appearance, adapted to many cosmetic products.

Various solutions are envisaged in the context of the bottle that is the object of the present invention for forming the channel (or channels) making it possible to balance the pressures between the interior and the exterior of the reservoir to favour migration of the product by capillarity. In general, the channel (or each channel) can have a substantially constant cross-section (perpendicular to its general direction of extension, which is typically mainly longitudinal).

In particular, an insert is interposed between an interior surface of the neck and an external surface of the application tip to form the at least one channel.

According to one embodiment, the insert can have the form of an elongate rod interposed between the interior surface of the neck and the external surface of the application tip and which extends between the interior volume of the reservoir and the exterior of the reservoir, said insert causing a transverse local deformation of the application tip that forms the at least one channel along the insert. In this case, and depending on the exact shape of the insert, a channel can be formed on each side of the insert. In this embodiment, the insert is therefore formed by a rigid material, more resistant to crushing than the porous material forming the application tip. It was found that such an insert made it possible to form a longitudinal channel in the immediate vicinity of its line of contact with the interior surface of the neck of the bottle. Selecting the cross section of the insert according to the material constituting the application tip makes it possible to correctly calibrate the cross section of the channel.

Alternatively, the insert is substantially cylindrical and includes an exterior surface that is mounted in contact with the interior surface of the neck and an interior surface in contact with the application tip.

With this general cylindrical configuration of the insert, or more precisely hollow or tubular cylindrical, the at least one channel can be formed in various ways.

The at least one channel can be formed by a groove provided on the interior surface of the insert or on the exterior surface of the insert.

The internal surface of the insert can include a rib projecting from the interior surface of the insert, said rib extending between the interior volume of the reservoir and the exterior of the reservoir, said rib causing a transverse local deformation of the application tip, which forms the at least one channel along said rib. The at least one channel is thus formed according to the same principle as when the insert is in the form of a longitudinal rod, which is described above.

The insert can include a collar that covers a top face of the neck, and the at least one channel then includes a transverse portion formed on the collar. This configuration enables in particular the applicator tip to cover the top face of the neck, so that the transverse dimensions of the base of the application tip (for example its diameter) can be the same as the exterior dimensions of the neck. In this case, each channel can be continued transversely in the same way as it is formed longitudinally (by an adapted groove or rib).

In all embodiments, the insert can for example be formed from a plastic material.

The applicator tip can be formed from various porous materials. The material selected must nevertheless allow or even favour migration of the product by capillarity, while nevertheless being little deformable under the effect of pressure on the skin (or other part of the body) when the product is applied.

By way of order of magnitude, it can be considered that, during the application of the cosmetic product, for example a lipstick, a mean force of approximately 3 N is applied by the user orthogonally to the surface on which the applicator tip is placed, to within plus or minus approximately 1.5 N. Thus a force of between 1.5 N and 4.5 N is applied. The porous material can be selected and the shape of the applicator tip adapted so that the tip does not significantly bend during the application of the product and so that the surface of the tip in contact with the skin during application undergoes slight crushing under a force of approximately 1 N to 2 N, for example 1.5 N.

Thus the porous material can include an interleaving of fibres. Preferentially, the fibres are oriented substantially longitudinally. This means that, when the structure of the material is observed with sufficient magnification to distinguish the fibres, it is clear that the fibres have a preferential orientation in the longitudinal direction. Thus pores having a longer longitudinal dimension greater (of even very much greater) than its longest transverse dimension are formed. This favours migration of the product by capillarity in the longitudinal direction. The fibres can be nylon fibres, by way of example. When the wick is not formed in a single piece with the application tip, it can advantageously have these same properties.

Alternatively, the porous material can be a plastic, metallic or ceramic sintered material.

Alternatively, the porous material can be a foam with open cells.

The reservoir of the bottle can be made from glass.

The neck can be configured to receive a cap closing the bottle that can be snapped or screwed onto said neck.

BRIEF DESCRIPTION OF THE FIGURES

Other advantages, aims and particular features of the present invention will arise from the following non-limiting description of at least one particular embodiment of the devices and methods objects of the present invention, with reference to the appended drawings, wherein:

FIG. 1 is a three-dimensional schematic view of a bottle in accordance with an embodiment of the invention;

FIG. 2 is a three-dimensional schematic view of a dispensing tip that can be used in a bottle in accordance with an embodiment of the invention;

FIG. 3 is a three-dimensional schematic view of a dispensing tip that can be used in a bottle in accordance with another embodiment of the invention;

FIG. 4 is a schematic view in cross section of the neck of the bottle of FIG. 1;

FIG. 5 is a view in cross section of a bottle in accordance with a variant of the present invention:

FIG. 6 is a view in cross section of a bottle in accordance with another variant of the present invention;

FIG. 7 is a partial three-dimensional view of a bottle in accordance with an embodiment of the invention;

FIG. 8 illustrates on a partial three-dimensional view an aspect of the bottle of FIG. 7;

FIG. 9 illustrates on a partial three-dimensional view an embodiment alternative to the one in FIG. 8;

FIG. 10 is a three-dimensional schematic view of a bottle in accordance with an embodiment of the invention;

FIG. 11 illustrates on a partial three-dimensional view an aspect of the bottle of FIG. 10;

FIG. 12 is a view in cross section of a bottle in accordance with a variant of the present invention.

DETAILED DESCRIPTION OF THE INVENTION

FIG. 1 is a three-dimensional schematic view of a bottle in accordance with an embodiment of the invention.

The bottle 1 includes a reservoir 2. The reservoir 2 includes a lateral wall 3 and a bottom 4, which define an interior volume 5 adapted to contain a cosmetic product. The reservoir can be made from glass. Any other adapted material can nevertheless be envisaged, for example plastics, metal (such as stainless steel or aluminium and some of the alloys thereof) and ceramic.

The bottle includes a neck 6 that forms an opening between the interior volume 5 of the reservoir 2 and the exterior 7 of the bottle 1. Exterior 7 of the bottle means the space surrounding the bottle, also described as the atmosphere external to the bottle.

The neck 6 can be adapted to receive a cap closing the bottle 1. In the example shown here, for this purpose the exterior surface 8 of the neck includes a thread 9 enabling an internally threaded cap to be screwed thereon.

The neck 6 moreover includes an interior surface that defines the passage between the interior volume 5 and the exterior 7 of the bottle. The general direction of extension of the neck 6 is said to be the longitudinal direction L. Any direction perpendicular to the longitudinal direction L is said to be transverse.

The bottle includes an applicator 10. The applicator 10 is mounted fixedly in the neck 6. The applicator 10 enables the product contained in the reservoir 2 to be applied to the skin (or other part of the body) of the user.

For this purpose, the applicator 10 includes an application tip 11. The application tip corresponds to the part of the applicator that includes the surface intended to be put in contact with the body of the user to apply the product. In the example shown, the application tip is conformed to allow easy application of the product to the lips. A "grape" shape is spoken of. Any other form of application tip can obviously be envisaged, depending on the area of application of the product in question.

According to the invention, the application tip 11 is formed from a porous material enabling the product to migrate inside said material.

A pore in general designates a microscopic channel existing in a solid material.

In order to enable the product to migrate from the internal volume 5 of the reservoir 2 to the application tip 11, the applicator includes a wick 12. The wick is itself formed from a porous material enabling the product contained in the reservoir 2 to transfer by capillarity. The wick 12 extends in the interior volume 5 of the reservoir 2, preferably as far as the bottom 4 or in proximity to the bottom 4. The wick thus dips in the cosmetic product present in the reservoir 2.

The wick 12 is, in the example in FIG. 1, formed in a single piece with the application tip 11.

In order to connect the applicator 10 to the neck 6 of the bottle 1, the application tip is configured so that it is mounted in the neck 6 so as to be impervious to the product. In order not to interfere with the migration of the product by capillarity in the application tip 11, the application tip 11 is nevertheless configured so as not to be crushed transversely in the neck (or at the very least not to be subjected to compression that would substantially reduce its porosity). In other words, the mounting of the application tip 11 in the neck is such that it enables the product to pass by capillarity from the interior volume of the reservoir to the surface of the application tip 11 intended to be put in contact with the body of the user to apply the product thereto.

Depending on the material constituting the application tip and by simple way of example, if a clamping of the application tip by the neck is provided, a reduction in cross section by compression of the application tip of a maximum of 20% can for example be allowable. Other attaching methods alternative or complementary to the clamping of the tip for securing in the neck can obviously be envisaged.

Examples of application tips are shown respectively in FIG. 2 and in FIG. 3.

FIG. 2 shows an application tip 11 formed from a foam, namely a foam consisting of nylon fibres. Other types of fibre, of plastic material or natural, can be used. The fibres can be mainly oriented substantially in the longitudinal direction L in order to favour migration of the product by capillarity in said longitudinal direction L. Many other types of foam can be used in the context of the present invention. A foam of the "felt" type, including an agglomerate of fibres having a random orientation, can be used. A foam formed from a sintered material (plastic or metal), keeping adapted porosity after sintering, can be used.

FIG. 3 shows an application tip 11 formed from an extruded material. The material has elongate pores 15 obtained during extrusion of the application tip.

In general terms, the porous material forming the application tip is selected so as to have great porosity, while being relatively resistant to compression. This is because the application tip must not be excessively compressed or deform when the product is applied to the body of the user. A hard foam, resistant to compression, is therefore preferred.

According to the present invention, a channel is provided between the interior volume 5 of the reservoir and the atmosphere exterior to the bottle (i.e. the exterior 7 of the bottle). The channel (or channels) has a cross-section calibrated so as not to allow spontaneous flow of the product, in particular when the bottle is turned over (neck 6 downwards). Nevertheless, passage of air, in a small quantity, is allowed by the channel, which makes it possible to balance the pressures between the interior volume of the reservoir and the exterior of the bottle 7.

The channel is nevertheless configured so that, when a cap is placed on the bottle 1 (typically on the neck 6) to close the bottle, it also closes the channel, which avoids exposing the product to air between two applications. This furthermore avoids any risk of leakage of product via the channel (even if, in any event, this channel is impervious to the product, i.e. it avoids spontaneous flow of the product). This makes it possible in particular to transport the bottle without risk of leakage.

The channel can be formed in various ways. In the example shown in FIG. 1, an insert 13 is interposed between the interior surface 14 of the neck 6 and the application tip 10. The insert 13 is in the general form of a rod, and is oriented longitudinally between the interior volume 5 of the reservoir and the exterior of the reservoir, at the end of the neck 6.

FIG. 4 illustrates how the insert 13 forms in this example channels 16 around the contact line between the insert 13 and the interior surface 14 of the neck 6. The insert 13 (the cross section of which is here exaggerated with respect to the cross section of the application tip 11) causes a local deformation of the application tip 11. The elasticity of the application tip 11 nevertheless does not enable it to totally fill in the space around the insert 13, which creates the channels 16.

It will be noted that the insert 13 has, at its end emerging outside the neck 6 and more generally outside the reservoir 2, a small elbow 17, which avoids the channel 16 being closed off at this level by the application tip 11 no longer undergoing the local deformation imposed by the insert 13. Alternatively, the insert 13 can simply be slightly extended outside the neck 6.

FIG. 5 shows, in cross section, an embodiment of the invention similar to the one in FIG. 1; The description made with reference to FIG. 1 above applies to the embodiment in FIG. 5, except for the differences explained below.

Since the wick 12 serves only to convey the product by capillarity to the application tip 11, it is not necessary for it to have a large cross section. In particular, it is not necessary for the wick 12 to have the same cross section as the application tip, the cross section of which can be mainly defined to allow mounting and securing in the neck 6.

The wick 12 of the embodiment in FIG. 5 therefore has a small cross section. The wick 12 of the embodiment in FIG. 5 has in particular a cross section very much smaller than that of the application tip 11, although it is formed in a single piece with said application tip 11. The volume available in the reservoir 2 for the product is thus increased.

FIG. 6 shows, in cross section, an embodiment of the invention similar to the one in FIG. 5. The description made with reference to FIG. 5 above applies to the embodiment in FIG. 5, except for the differences explained below.

Although the porous material used to form the application tip 11 is generally adapted to cause migration of the product from the interior volume 5 of the reservoir to the application tip 11, it is not always easy to produce the application tip 11 and the wick 12 of the applicator 10 in a single piece. Furthermore, the material constituting the wick 12 can be optimised to favour migration of the product by capillarity, compared with the material of the application tip, which must meet other requirements (for example a certain mechanical resistance to compression to allow application of the product without being excessively crushed, and a certain softness felt during application). There are not the same constraints for the material constituting the wick 12, which can be flexible and/or compressible, since it is never mechanically stressed by the user.

In the embodiment in FIG. 6, the wick 12 is connected to the application tip 11, in a manner enabling the cosmetic product to pass from the wick 12 to the application tip 11. In this case, the wick 12 is fitted in the application tip 11.

FIG. 7 is a partial view of a bottle in accordance with an embodiment of the invention; On FIG. 7, the application tip has been omitted. In this embodiment, compared with the embodiments previously described, the insert 13 has a roughly cylindrical shape, and constitutes an interface between the interior surface 14 of the neck 6 and the application tip 11, over the whole of its periphery.

Thus the insert 13 includes an exterior surface 18 that is mounted in contact with the interior surface 14 of the neck 6. The exterior surface 18 can thus be optimised to ensure good holding of the insert in the neck 6, and impermeability to the product and to the air between the insert 13 and the neck 6.

The exterior surface 18 can thus include peripheral ribs and/or a flexible overmoulding.

The interior surface 19 of the insert 13 is for its part in contact with the application tip 11, so that the insert provides the mounting and holding of the application tip 11 in the neck 6.

When such an insert 13 is used, various solutions can be envisaged to form the channel making it possible to balance the pressure between the interior volume 5 of the reservoir and the exterior of the bottle 1.

The solution used in FIG. 7 is explained in more detail on the detail view in FIG. 8. FIG. 8 presents the end of the insert 13 opposite to the interior volume 5 of the reservoir 2, i.e. the end of the insert 13 located at the free end of the neck 6. According to this embodiment, the internal surface 19 of the insert 13 includes a rib 20. The rib 20 is formed projecting from the internal surface 19 of the insert 13. The rib 20 is substantially longitudinal. The rib 20 acts like the insert 13 in the general form of a rod in FIGS. 1 to 6, and forms a channel for balancing the pressure between the interior volume of the reservoir 2 and the exterior of the reservoir 7, as explained with reference to FIG. 4. The shape of the rib, seen in cross section, can be adapted to calibrate the channel precisely.

Alternatively, the channel 16 is formed by a groove 21 formed on the interior surface of the insert 13. Despite its optional flexibility, the application tip 11 does not fill in the groove 21 once placed in the neck 6 and therefore in the insert 13.

Alternatively again (see FIG. 12), the groove 21 can be formed on the exterior surface 18 of the insert, so that the pressure equilibrium between the interior volume 5 of the reservoir and the exterior of the bottle 7 is made by the channel thus formed between the insert 13 and the interior surface 14 of the neck 6.

As can be seen on FIGS. 7 to 9, the insert 13 furthermore includes an optional collar 22. The collar 22 covers a top face 23 of the neck 6.

The collar 22 forms a transverse portion 24 of the channel 16. It is thus possible, as shown in FIG. 10, to give the application tip 11 a form completely covering the top face 23. Apart from the possibility of having a wider application tip 11, this gives the bottle a more aesthetic appearance. Finally, this avoids a possibility of retention of product in an angle formed between the application tip and the top face 23.

In order to form a transverse portion 24 of the channel 16, the channel 16 is continued radially at the collar 22, preferentially in the same way that it is formed longitudinally by the insert 13. By way of example, FIG. 11 illustrates how the channel 16 formed longitudinally by a groove 21, as shown in FIG. 9, is continued by a transverse groove emerging in the groove 21, as well as a transverse portion 24 of the channel that emerges on an edge of the top face 23 of the neck 6.

If the channel 16 is formed longitudinally by a rib, it can be extended transversely by a corresponding rib. A transverse groove can also be used in this case.

FIG. 12 illustrates, in a view in cross section, an embodiment of the invention wherein the insert 13 includes a collar 22 enabling the application tip 11 to have the same width as the neck 6, all the top surface of which it thus covers. The groove that forms the channel 16 in this embodiment is formed on the exterior surface 18 of the insert 13, between the insert 13 and the interior surface 14 of the neck 6. In order to enable the interior volume 5 of the bottle to be put in communication with the exterior of the bottle, a transverse portion 24 of the channel 16 is formed under the collar 22, between the top surface 23 of the neck 6 and said collar 22.

Thus, according to the present invention, a bottle is proposed for the packaging, dispensing and application of a liquid cosmetic product, which is simple and without any complex mechanism using moving parts, and which does not require dipping the application tip in the product on several occasions. With the bottle proposed in the invention, the application action is simple and natural. The risk of loss of product by tipping over the bottle is eliminated. By virtue of establishing an air passage, nevertheless impervious to the product, between the interior volume of the reservoir and the exterior of the bottle, pressure equilibrium is established between the interior of the reservoir and the exterior, which creates conditions adapted to the migration of the product by capillarity to and in the porous application tip.

The invention claimed is:

1. A bottle comprising:

a reservoir including an interior volume containing a cosmetic liquid product;

the reservoir including a neck extending in a longitudinal direction between the interior volume of the reservoir and an exterior of said reservoir;

the bottle including an applicator mounted in the neck;

the applicator including an application tip configured to be put in contact with a part of a body of a user of the bottle to apply the product thereon;

the application tip having an application surface formed by a porous material;

the application tip being formed from said porous material;

the applicator includes a porous wick formed by the application tip or connected to the application tip, said wick extending in the reservoir so as to be dipped into the product;

the applicator being mounted in the neck so as to be impervious to the product;

the bottle including at least one channel extending in the neck between the interior volume of the reservoir and the exterior of the reservoir, the at least one channel having a cross-section calibrated to allow the passage of air while opposing the passage of product;

the bottle includes an insert interposed between an interior surface of the neck and an external surface of the applicator; and the insert causing a transverse local deformation of the applicator that forms the at least one channel along the insert.

2. The bottle according to claim 1, wherein:

the insert has a form of an elongate rod interposed between the interior surface of the neck and the external surface of the applicator and which extends between the interior volume of the reservoir and the exterior of the reservoir.

3. The bottle according to claim 1, wherein:

the insert is cylindrical and includes an exterior surface that is mounted in contact with the interior surface of the neck and an interior surface in contact with the applicator.

4. The bottle according to claim 3, wherein:

the internal surface of the insert includes a rib projecting from the interior surface of the insert;

the rib extending between the interior volume of the reservoir and the exterior of the reservoir.

5. The bottle according to claim 3, wherein:

the insert includes a collar that covers a top face of the neck; and the at least one channel includes a transverse portion formed on the collar.

6. The bottle according to claim 1, wherein:

the porous material includes an interleaving of fibres.

7. The bottle according to claim 1, wherein:

the porous material is a plastic, metallic, or ceramic sintered material.

8. The bottle according to claim 1, wherein:

the porous material is a foam with open cells.

9. The bottle according to claim 1, wherein:

the reservoir is made from glass.

10. The bottle according to claim 1, wherein:

the neck is configured to receive a cap closing the bottle and configured to be snapped or screwed onto said neck.

11. A bottle comprising:

a reservoir including an interior volume containing a cosmetic liquid product;

the reservoir including a neck extending in a longitudinal direction between the interior volume of the reservoir and an exterior of said reservoir;

the bottle including an applicator mounted in the neck;

the applicator including an application tip configured to be put in contact with a part of a body of a user of the bottle to apply the product thereon;

the application tip having an application surface formed by a porous material;

the application tip being formed from said porous material;

the applicator includes a porous wick formed by the application tip or connected to the application tip, said wick extending in the reservoir so as to be dipped into the product;

the applicator being mounted in the neck so as to be impervious to the product;

the bottle including at least one channel extending in the neck between the interior volume of the reservoir and the exterior of the reservoir, the at least one channel having a cross-section calibrated to allow the passage of air while opposing the passage of product;

the bottle includes an insert interposed between an interior surface of the neck and an external surface of the applicator;

the at least one channel being formed by the insert; and the insert is cylindrical and includes an exterior surface that is mounted in contact with the interior surface of the neck and an interior surface in contact with the applicator;

wherein the at least one channel is formed by a groove provided on the interior surface of the insert or on the exterior surface of the insert.

12. The bottle according to claim 11, wherein:

the porous material includes an interleaving of fibres.

13. The bottle according to claim 11, wherein:

the porous material is a plastic, metallic, or ceramic sintered material.

14. The bottle according to claim 11, wherein:

the porous material is a foam with open cells.

15. The bottle according to claim 11, wherein:

the reservoir is made from glass.

16. The bottle according to claim 11, wherein:

the neck is configured to receive a cap closing the bottle and configured to be snapped or screwed onto said neck.

* * * * *